US006536072B2

(12) United States Patent
Thur et al.

(10) Patent No.: US 6,536,072 B2
(45) Date of Patent: Mar. 25, 2003

(54) COMPRESSION LATCH FOR DIRT CUP

(75) Inventors: Charles J. Thur, Chardon, OH (US); Michael A. Seifried, Euclid, OH (US); Paul D. Stephens, Twinsburg, OH (US); Steven J. Paliobeis, Painesville, OH (US); Jeffrey M. Kalman, Cleveland Heights, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 0 days.

(21) Appl. No.: 09/758,725

(22) Filed: Jan. 11, 2001

(65) Prior Publication Data

US 2002/0088077 A1 Jul. 11, 2002

(51) Int. Cl.[7] ..... A47L 9/00
(52) U.S. Cl. ..... 15/323; 15/352; 55/429
(58) Field of Search ..... 15/352, 323; 55/429

(56) References Cited

U.S. PATENT DOCUMENTS 2,060,168 A * 11/1936 Brock ..... 55/429
3,040,362 A * 6/1962 Krammes ..... 15/352
4,665,582 A * 5/1987 Richmond et al. ..... 15/352
5,107,567 A * 4/1992 Ferrari et al. ..... 15/352
5,247,719 A 9/1993 Wareham et al.
5,935,279 A * 8/1999 Kilstrom ..... 55/429
6,168,641 B1 * 1/2001 Tuvin et al. ..... 55/429
6,192,550 B1 * 2/2001 Hamada et al. ..... 15/352
6,256,834 B1 * 7/2001 Meijer et al. ..... 55/429

* cited by examiner

*Primary Examiner*—Chris K. Moore
(74) *Attorney, Agent, or Firm*—Fay, Sharpe, Fagan, Minnich & McKee, LLP

(57) ABSTRACT

A dirt cup latching arrangement includes a cleaner housing portion and a dirt cup mounted on the housing portion to define a mounted position. A latch assembly is pivotally mounted to the housing portion. A catch frame is pivotally mounted to the housing portion in spaced relation to the latch assembly. The latch assembly and the catch frame cooperate to selectively secure the dirt cup to the housing portion. A tool storage arrangement can include a cap pivotally mounted to the housing with the cap having an upper surface and a lower surface. At least one indentation is located on the cap upper surface and is shaped for accommodating an associated cleaning tool of the vacuum cleaner.

18 Claims, 8 Drawing Sheets

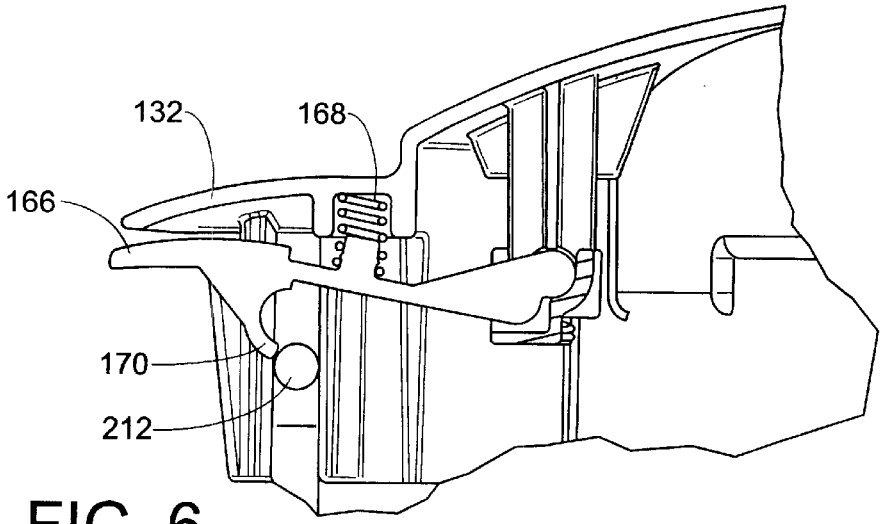
FIG. 6
FIG. 5
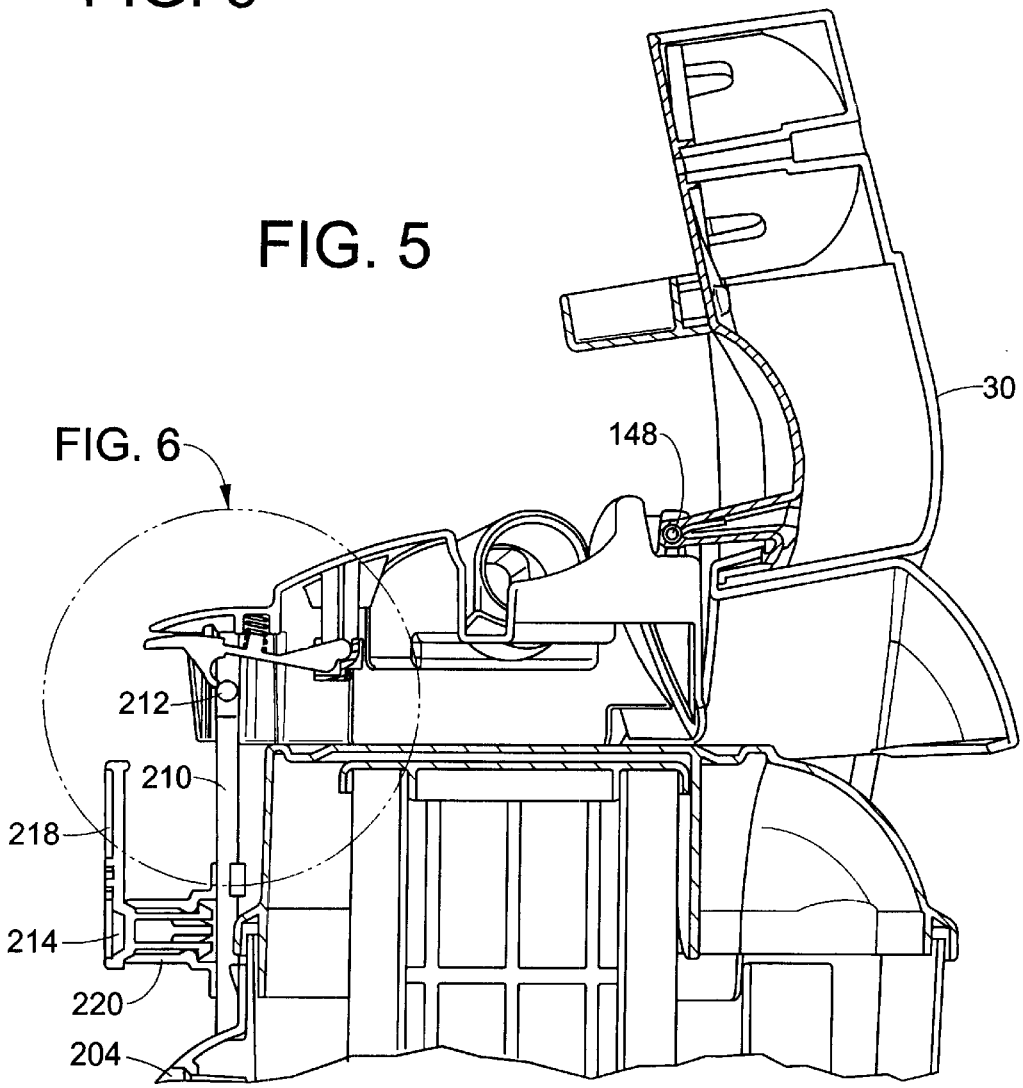

COMPRESSION LATCH FOR DIRT CUP

BACKGROUND OF THE INVENTION

This invention relates to vacuum cleaners. More particularly, it relates to a dirt cup latching arrangement for an upright vacuum cleaner. It also relates to a tool storage arrangement provided by a portion of the dirt cup latching arrangement.

The use of dirt cups, instead of filter bags, in vacuum cleaners is well known. The dirt cups receive and store suctioned dirt, hair, fibers and the like. Such dirt cups must be secured in place on the vacuum cleaner housing when the vacuum cleaner is in use and must be detachable from the vacuum cleaner for emptying. It is known to provide mounting and latching arrangements for dirt cups on such vacuum cleaners. However, the latching arrangements thus far employed are not optimum. A need exists for a dirt cup latching arrangement which is capable of accommodating a dirt cup that is removable from the rear side of the vacuum cleaner housing, rather than the front side thereof. A need also exists for storing above-floor cleaning tools on the vacuum cleaner. It would be desirable if the dirt cup latching arrangement could do double duty by serving also as a location for accommodating such above-floor cleaning tools.

Accordingly, it has been considered desirable to develop a new and improved vacuum cleaner having a dirt cup latching arrangement which would overcome the foregoing difficulties and others and meet the above stated needs while providing better and more advantageous overall results.

BRIEF SUMMARY OF THE INVENTION

One aspect of the present invention relates to a dirt cup latching arrangement for a vacuum cleaner.

More particularly in accordance with this aspect of the invention, the arrangement includes a cleaner housing portion and a dirt cup mounted to the housing portion defining a mounted position. The latch assembly is pivotally mounted to the housing portion. A catch frame is pivotally mounted to the housing portion in spaced relation to the latch assembly. The latch assembly and the catch frame cooperate to selectively secure the dirt cup to the housing portion.

In accordance with another aspect of the invention, a latch arrangement is provided for a vacuum cleaner having a dirt cup and a housing. More particularly, in accordance with this aspect of the invention, the latch arrangement comprises a latch hook mounted on a lower surface of a latch frame pivotally mounted to the housing and a catch member located on a catch frame pivotally mounted to the housing in a spaced manner from the latch frame. The latch hook and the catch member cooperate to selectively hold the dirt cup on the vacuum cleaner.

In accordance with a still another aspect of the present invention, a tool storage arrangement is provided for a vacuum cleaner.

More particularly in accordance with this aspect of the invention, the tool storage arrangement comprises a housing and a cap pivotally mounted to the housing, the cap having an upper surface and a lower surface. At least one indentation is located on the cap upper surface and shaped for accommodating an associated cleaning tool of the vacuum cleaner.

In accordance with yet another aspect of the present invention, a tool storage arrangement is provided for a hard shell upright vacuum cleaner.

More particularly in accordance with this aspect of the invention, the tool storage arrangement comprises a nozzle base, a housing pivotally mounted on the nozzle base with the housing having an opening therein. A dirt cup is selectively mounted in the opening on the housing. A cap is pivotally mounted to the housing in a manner to over lie the dirt cup when it is mounted on the housing. The cap has an upper surface and a lower surface. At least one indentation is located on the cap upper surface for accommodating an associated cleaning tool of the vacuum cleaner.

In accordance with a further aspect of the present invention, a hose storage arrangement is provided for a hard-shell upright vacuum cleaner.

More particularly in accordance with this aspect of the invention, the hose storage arrangement comprises a nozzle base and a housing pivotally mounted on the nozzle base. The housing comprises a lower handle portion which comprises a leg having a channel defined therein and an above-floor cleaning hose selectively mounted in said channel for storage.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein:

FIG. 5 is an enlarged view of a portion of the vacuum cleaner of FIG. 3 with the latching arrangement shown in the process of being unlatched;

FIG. 6 is a greatly enlarged view of a portion of the latching arrangement of FIG. 5;

DESCRIPTION OF THE PREFERRED EMBODIMENT

Figure 1:
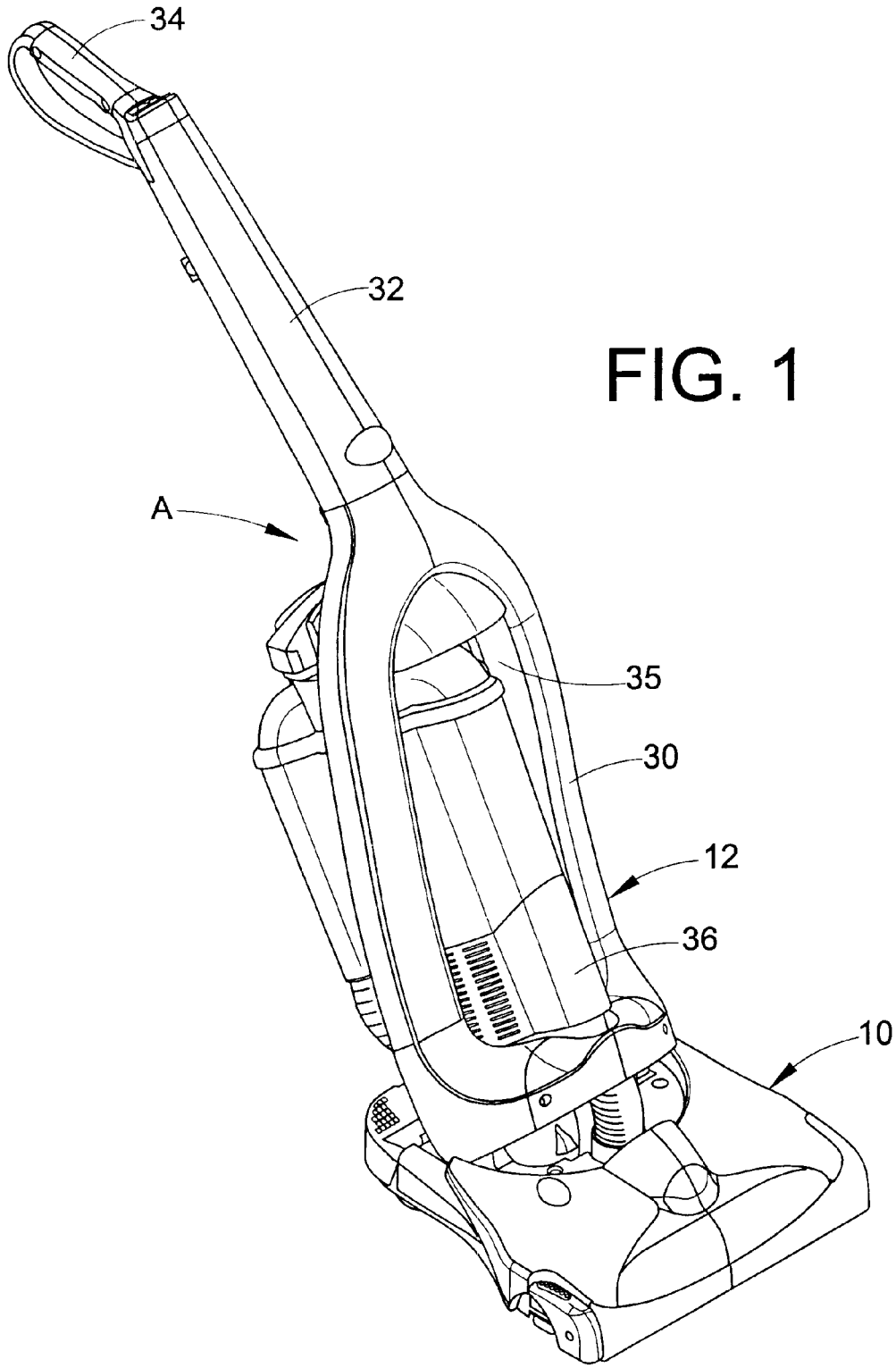
FIG. 1 is a perspective view from the front left of a vacuum cleaner according to the present invention.

Referring now to the drawings, wherein the showings are for purposes of illustrating a preferred embodiment of the invention only and not for purposes of limiting same, FIG. 1 shows the subject new latching arrangement and tool storage arrangement as embodied in a particular type of upright vacuum cleaner. While the latching arrangement and tool storage arrangement can be employed in this type of vacuum cleaner, it should be appreciated that the latching arrangement and tool storage arrangement can be used in other types of vacuum cleaners as well.

Figures 2, 2A:
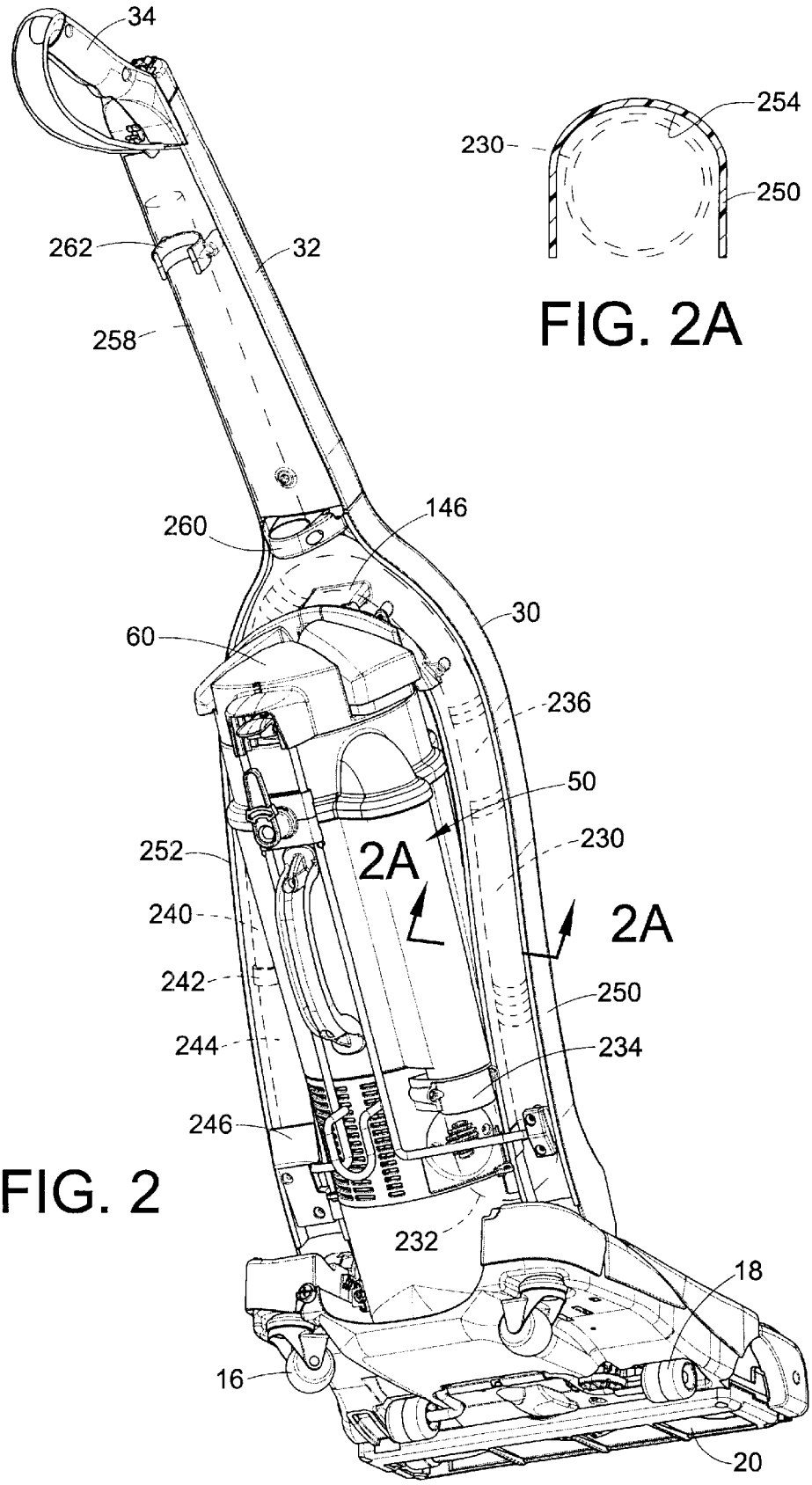
FIG. 2 is a perspective view from the rear left of the vacuum cleaner of FIG. 1.
FIG. 2A is a cross-sectional view along line 2A—2A of a portion of the vacuum cleaner of FIG. 2.
Figure 3:
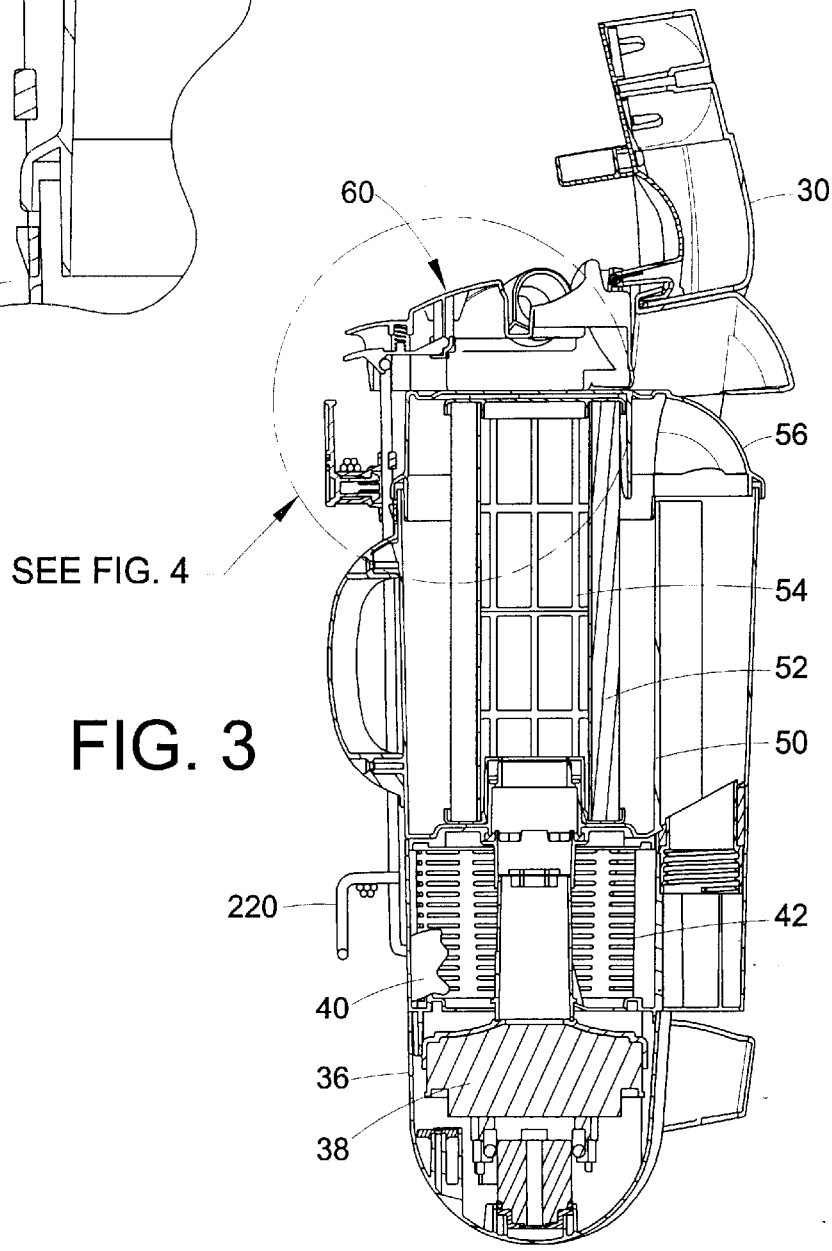
FIG. 3 is a cross-sectional view of a portion of the vacuum cleaner of FIG. 1.

FIG. 1 illustrates a vacuum cleaner A including a nozzle base 10 and an upper assembly 12. As best illustrated in FIG. 2, the nozzle base 10 has a lower surface on which are located casters 16 and rollers 18 which enable the nozzle base to move across the subjacent floor surface. Also, a suction opening 20 is located adjacent a front end of the lower surface of the nozzle base. With reference again to FIG. 1, the upper assembly includes a lower handle portion 30, an upper handle portion 32 and a hand grip 34. As is evident, the lower handle portion 30 is U-shaped or, perhaps wishbone shaped, and includes a pair of legs which define between them an opening 35. Extending into that opening is a motor and filter housing 36 mounted on the upper assembly. With reference now to FIG. 3, located in the motor and filter housing 36 is a motor 38 and a final filter 40. A set of openings 42 are provided in the housing to allow exhaust airflow through the final filter 40 and out of the housing.

Mounted on the motor and filter housing 36 is a dirt cup 50. Located in the dirt cup is a filter 52 which is mounted on a cage 54. Covering an open upper end of the dirt cup is a lid 56.

Figure 7:
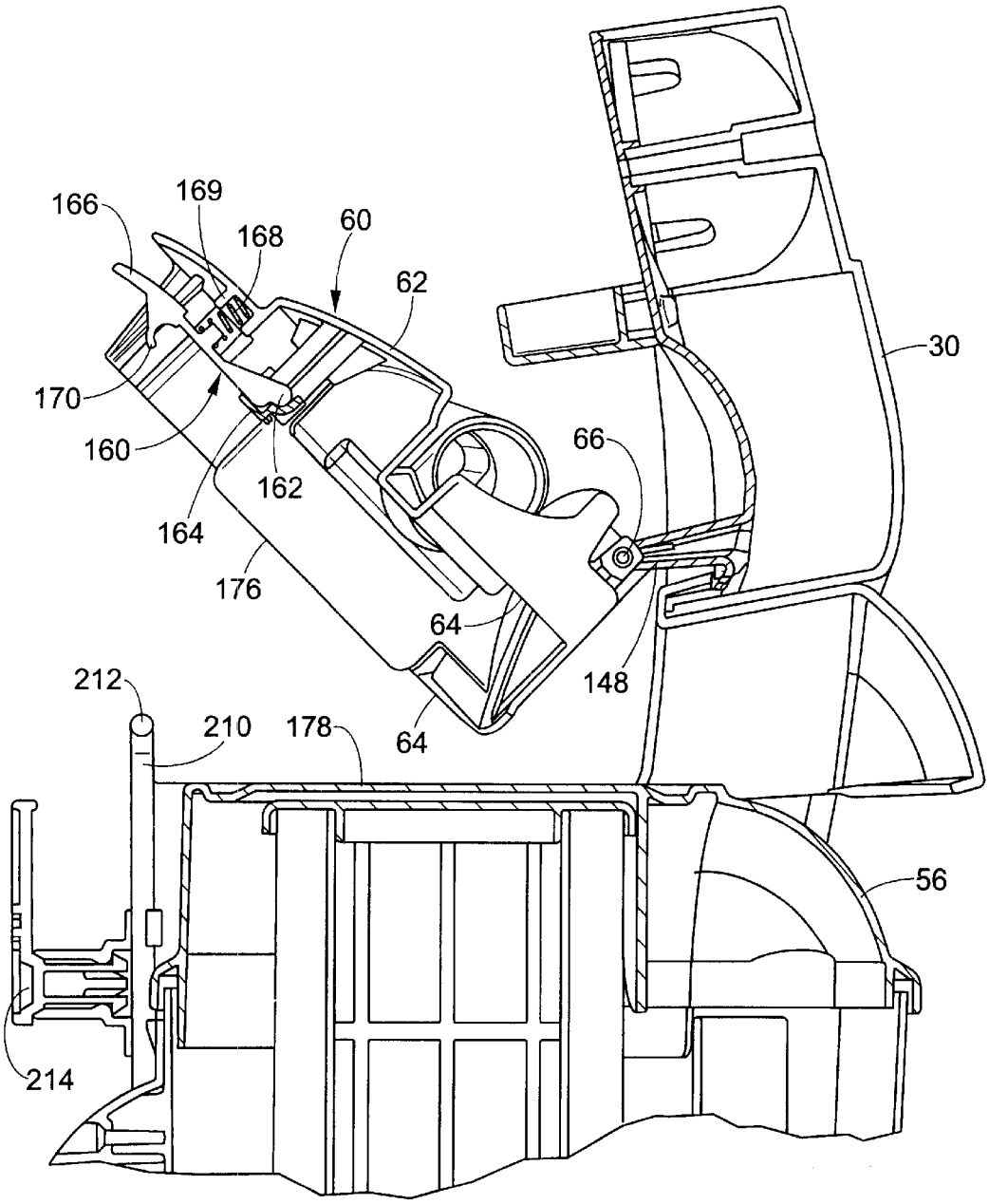
FIG. 7 is a cross-sectional view of the assembly of FIG. 5 with the latching arrangement shown in a completely unlatched condition.

Pivotally mounted above the lid 56 is a cap 60. The cap is mounted to the lower handle portion 30 as may be best seen in FIG. 2. With reference now to FIG. 7, the cap has an upper surface 62 and a lower surface 64 as well as a hinge construction 66 by which it is mounted to the lower handle portion 30.

Figure 9:
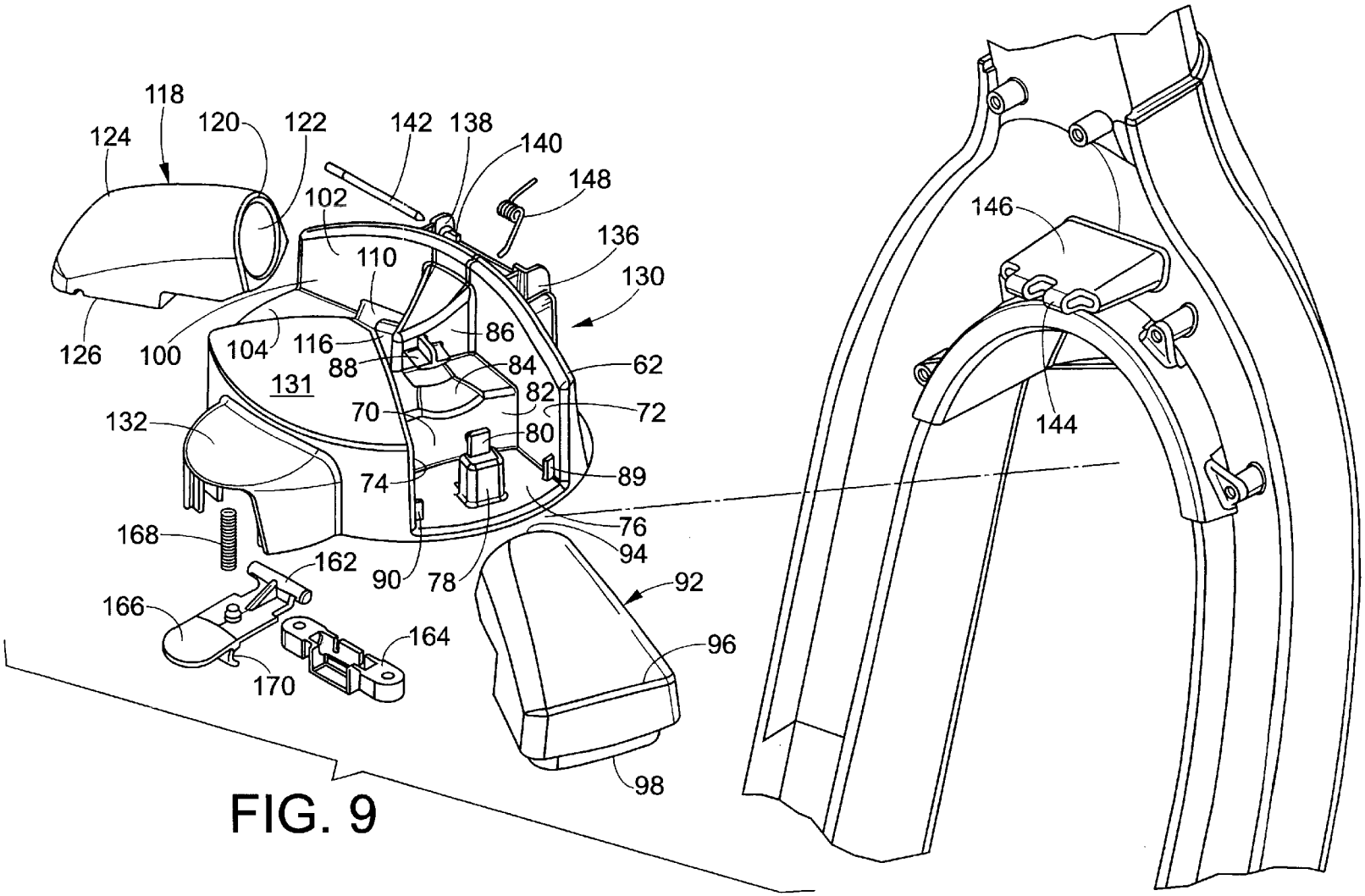
FIG. 9 is an exploded perspective view of a cap of the latching arrangement of FIG. 3 and a pair of above-floor cleaning tools, together with an associated portion of the vacuum cleaner.

With reference now to FIG. 9, the cap upper surface 62 includes a first recess 70 defined by a pair of opposed side walls 72 and 74 and a base wall 76. Extending upwardly from the base wall is a stub 78 on which is mounted a locking finger 80. Positioned rearwardly of the stub 78 is a plateau 82 in which is located a depression 84. Located rearwardly of the plateau is a back wall 86 from which extends a stabilizing protrusion 88. Extending toward the stub 78 from the opposed side walls 72 and 74 are a pair of flanges 89 and 90. A first above-floor cleaning tool 92 is adapted to be mounted in the first recess 70. The first cleaning tool includes a first end 94, second end 96 and a cleaning surface 98 having a nozzle opening. An aperture (not visible) in the cleaning tool first end 94 receives the stabilizing protrusion 88. A second aperture (not visible) in the cleaning tool accommodates the locking finger 80. The pair of flanges 89 and 90 serve to insure that the tool 92 is correctly positioned in the recess 70.

Spaced from the first recess 70 in the upper surface 62 of the cap is a second recess 100. The second recess comprises a pair of opposed side walls, of which only a first wall 102 is visible, as well as a base wall 104. A locking finger (not visible) protrudes from the base wall. Located rearwardly of the locking finger is a plateau 110 which can have a depression (not visible) to accommodate a portion of a cleaning tool. Mounted on the back wall 86 is a stabilizing protrusion 116. To this end, the back wall 86 is somewhat wedge-shaped so that the two stabilizing protrusions 88 and 116 are oriented at an acute angle in relationship to each other. Adapted to be mounted in the second recess 100 is a second above-floor cleaning tool 118. The second cleaning tool 118 has a first end 120 with an opening 122 which accommodates the stabilizing protrusion 116. The tool also has a second end 124 and a cleaning surface 126 in which is located a nozzle opening which overlies the base wall 104 of second recess 100.

Figure 8:
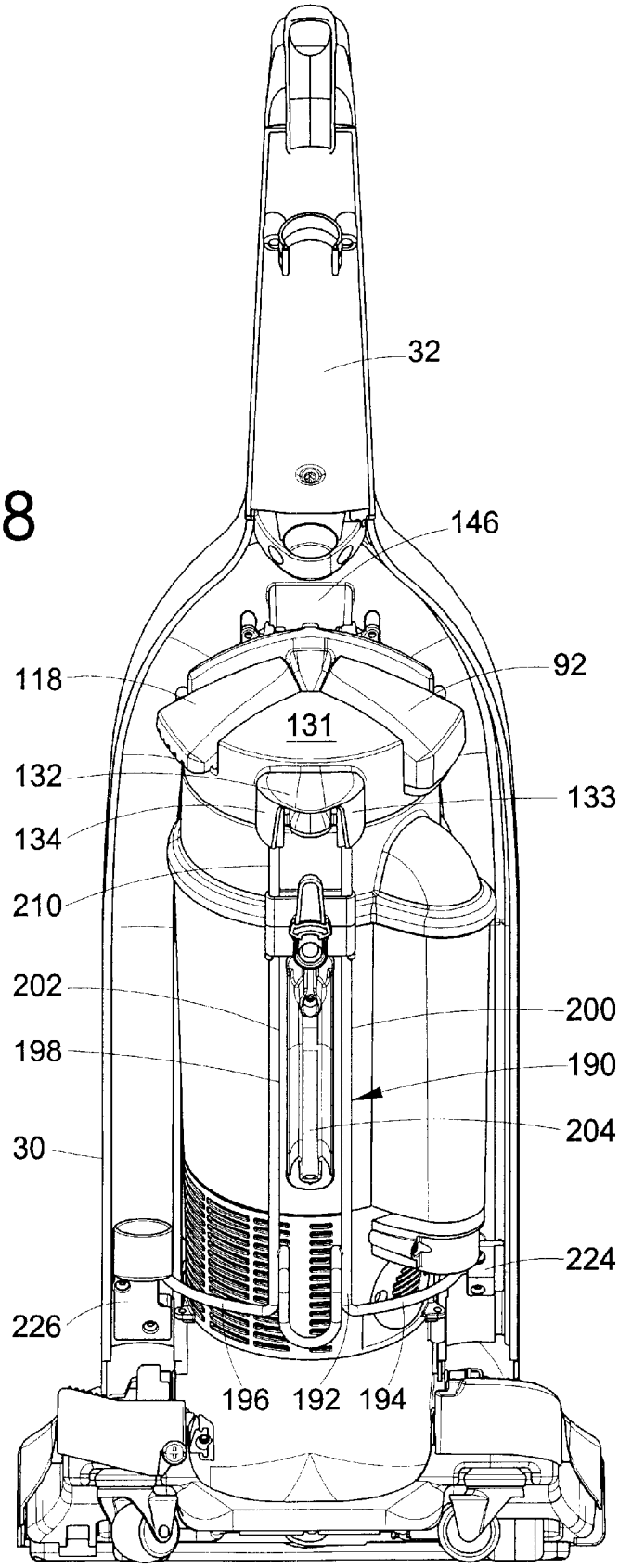
FIG. 8 is a rear elevational view of the vacuum cleaner of FIG. 1.

Located rearwardly of the two recesses 70 and 100 is a pivot area 130 of the cap. Located forwardly of the two recesses is a wedge-shaped portion 131 from which extends a hand hold 132. As best illustrated in FIG. 8, the hand hold includes a pair of side walls 133 and 134. With reference again to FIG. 9, the pivot area 130 comprises a pair of spaced side walls 136 and 138 with a respective knuckle 140 (only one of which is visible) of a hinge extending approximately normal to its wall. Supported by the knuckles is a hinge pin 142. The knuckles extend towards each other and cooperate with respective knuckles 144 defined on a frame 146 (FIG. 2) which extends rearwardly from the lower handle portion 30. Thus the knuckles 140 and 144 are aligned so as to accommodate the hinge pin 142 and cooperate to form a hinge. A spring 148 is mounted on the hinge pin 142 and resiliently biases the cap 60 clockwise, toward a rear surface of the lower handle portion 30 and away from the dirt cup lid 56.

With reference now also to FIG. 7, the bottom surface 64 of the cap 60 includes a latch member 160 which has a first end 162 pivotally mounted in a housing 164 secured to the cap lower surface 64 and a second end 166 which is adapted for hand manipulation. A spring 168, mounted in a housing 169 integrally defined on the cap lower surface 164, resiliently biases the latch 160 to one end position. Defined on the latch between its ends 162 and 166 is a latch hook 170. Also provided on the cap lower surface 64 is a depending contact portion 176 which butts against an upper surface 178 of the lid 156 to secure the dirt cup 50 in position on the upper assembly 12 when the dirt cup is mounted on the upper assembly 12 and the latch is in use.

With reference now also to FIG. 8, pivotally mounted on the lower handle portion 30 is a catch frame 190. The catch frame includes a first or lower end 192 comprising first and second oppositely extending legs 194 and 196 as well as a central portion 198. The central portion includes spaced first and second rods 200, 202. The rods are spaced far enough apart so as to accommodate a handle 204 of the dirt cup 50. With reference now to FIG. 5, the catch frame 190 also has a second end 210 on which is defined a rod-shaped catch member 212. Mounted adjacent the second end 210 is a first cord hook 214. As best shown in FIG. 2, mounted adjacent the catch frame first end 192 is a second cord hook 216 which can be defined by a wire form member suitably secured to the catch frame. While the second cord hook 216 can be made on the suitable conventional metallic material, the first cord hook 214 can be made from a plastic material. As illustrated in FIG. 5, the first cord hook 214 can include a first section 218 which is rotatable in relation to a second section 220 mounted on the catch frame adjacent its second end 210. As illustrated in FIG. 3, an electrical cord 220 of the vacuum cleaner can be wound around the two cord hooks 214, 216 when so desired. As shown in FIG. 8, the two legs 194, 196 of the catch frame first end 192 are mounted in respective housings 224 and 226 secured to the lower handle portion 30.

Figure 4:
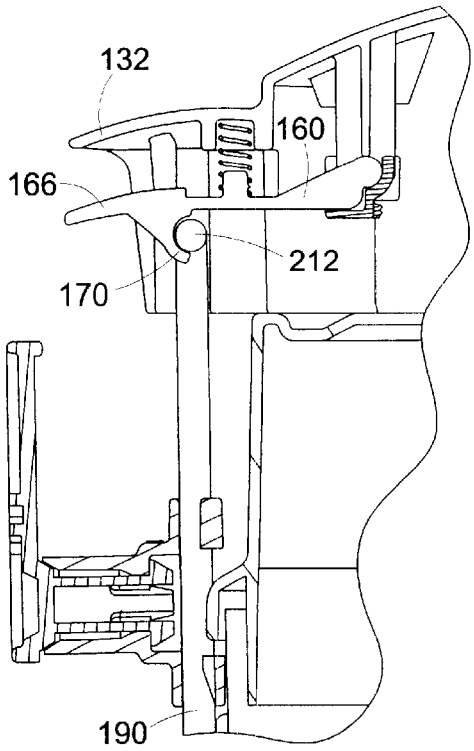
FIG. 4 is an enlarged cross-sectional view of a latching portion of the vacuum cleaner of FIG. 3 with a latching arrangement thereof shown in a latched condition.
Figure 10:
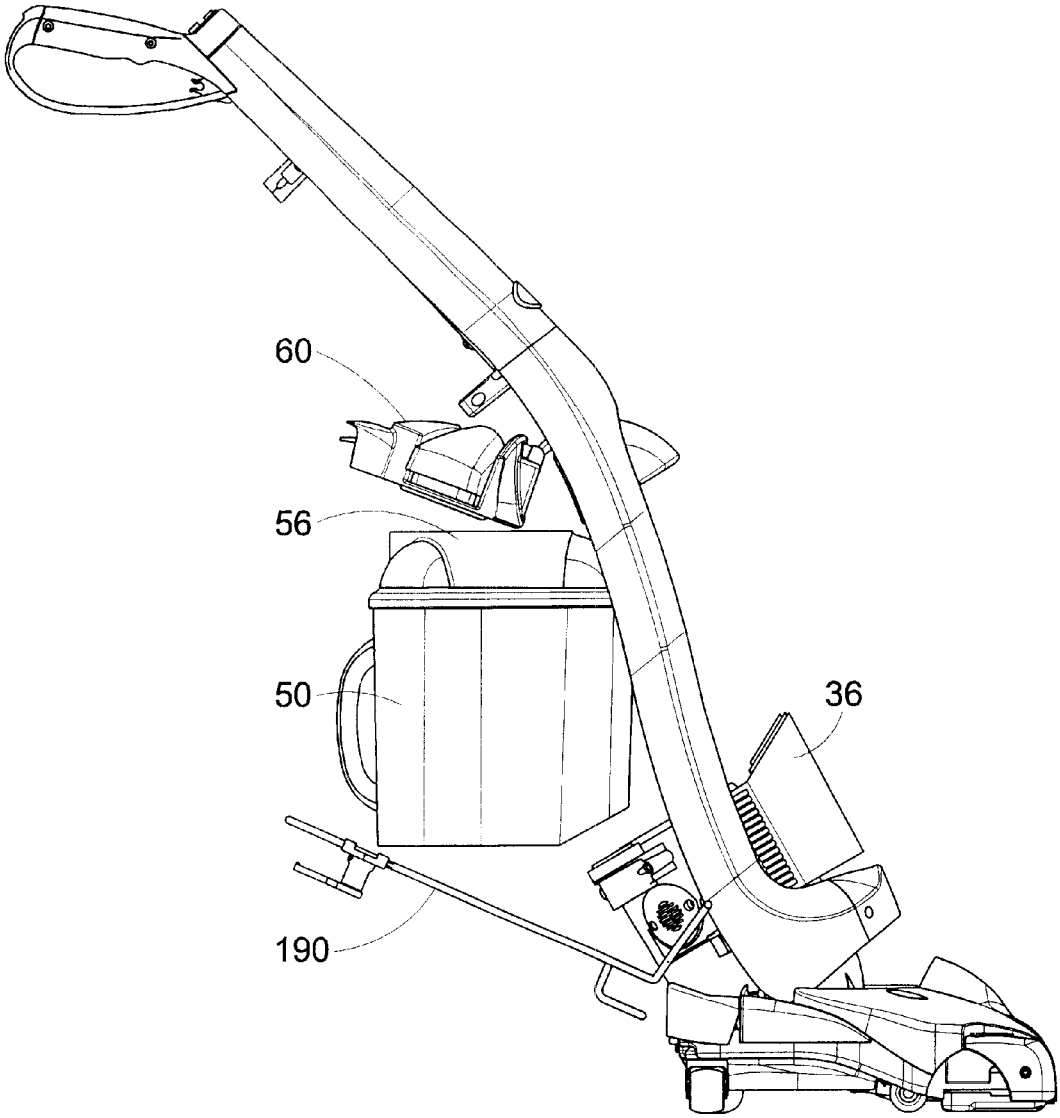
FIG. 10 is a side elevational view of the vacuum cleaner of FIG. 1 illustrating the removal of a dust cup from the vacuum cleaner.

The operation of the dirt cup latching arrangement is as follows. Assuming that the dirt cup is secured to the upper assembly 12 of the vacuum cleaner as illustrated in FIG. 3, the latch hook 170 engages the catch member 212 of the catch frame 190, as best shown in FIG. 4. When the operator decides to remove the dirt cup 50 from the upper assembly 12, the operator pivots the latch 160 upwardly by manually moving the handle-shaped latch second end 166 toward the hand hold 132 against the bias of the spring 168. Due to the resilience of the plastic material from which the latch 160 is made, the latch hook 170 then clears the catch member 212 as illustrated in FIG. 6. During this time period, the spring 168 is compressed. Subsequently, the spring 148 will bias the cap away from the dirt cup lid 56 as shown in FIG. 7. At the same time, the spring 168 will urge the latch 160 away from the hand hold 132. Now, the catch frame 190 can be pivoted away from the dirt cup 50 as shown in FIG. 10. Once this is done, the handle 204 of the dirt cup can be grasped, as the rods 200, 202 defining the central portion 198 of the catch frame are no longer in the way, and the dirt cup can be removed.

After the dirt cup 50 is cleaned, it can be reinstalled on the vacuum cleaner upper assembly 12 with the cap 60 then securing the dirt cup in place. To this end, the catch frame 190 is pivoted to its upright position so that the catch member 212 is ready to accommodate the latch hook 170. The cap 60 is then rotated counterclockwise, against the bias of the spring 148, until the contact surface 176 on the cap lower surface 164 engages the upper surface 178 of the lid as shown in FIG. 7. Now, as shown in FIG. 6, the latch second end 166 is manually engaged to urge the latch hook 170 around the catch member 212. Once engagement is made, as illustrated in FIG. 4, the dirt cup 50 is secured in place and is ready to be used.

The cap 60 and the latch 160 are preferably made from a suitable conventional plastic material. On the other hand, the catch frame 190 can be made from a suitable metallic wire rod material. The nozzle base 10 and the upper assembly 12 can be made from any suitable material, including a variety of plastic materials as well as some types of metals.

With reference now again to FIG. 2, a hose 230 is looped around a rear side of the lower handle portion 30. More particularly, the hose 230 has a first end 232 which is secured by a first connector 234 to an inlet of the dust cup 50. The hose has a main portion 236 and a second end 240 which is secured via a second connector 242 to a wand 244. A free end of the wand is supported in a cup 246 mounted on a rear side of the lower handle portion 30. As is evident from FIG. 2, the lower handle portion 30 comprises a pair of legs 250 and 252. With reference now also to FIG. 2A, it can be seen that the leg 250 is essentially U-shaped so as to form a channel 254 in which is accommodated the hose 230. This construction allows for an unobtrusive storage area for the hose when not used for above-floor cleaning. The hose is supported in the channel such that the first end 232 of the hose is secured by the first connector 234 to the dust cup 50, a central portion of the hose is supported on the bridge 146 and the second end of the hose 240 is fastened to the wand 244 which, in turn, is supported by the cup 246 mounted to the lower handle portion 30. When it is desired to use the vacuum cleaner for above-floor cleaning, the wand 244 is removed from the cup 246 and the hose can then be used for cleaning above-floor surfaces. To this end, one of the above-floor cleaning tools 92, 118 or a similar tool can be connected to the free end of the wand. Also, a spare wand 258 can be supported by the upper handle portion 232 with one end of this wand being held in a cup 260 and another portion of such wand being held in a clip 262.

The invention has been described with reference to a preferred embodiment. Obviously, modifications and alterations will occur to others upon the reading and understanding of this specification. It is intended to include all such modifications and alterations insofar as they come within the scope of the appended claims or the equivalents thereof.

Having thus described the invention, it is claimed as follows:

1. A dirt cup latching arrangement for a vacuum cleaner comprising:

a nozzle base;

a housing portion including an opening, said housing portion being pivotally mounted on said nozzle base;

a dirt cup selectively mounted in said opening of said housing portion, defining a mounted position;

a latch assembly pivotally mounted to said housing portion; and, a catch frame pivotally mounted to said housing portion in spaced relation to said latch assembly, wherein at least one of said latch assembly and catch frame is separate from said dirt cup and wherein said latch assembly and said catch frame are so mounted on said housing that they cooperate to selectively secure said dirt cup in said housing portion opening.

2. The arrangement of claim 1 wherein said catch frame comprises an electrical cord holding portion.

3. The arrangement of claim 2 wherein said catch frame cord holding portion comprises:

a first hook mounted on said catch frame; and, a second hook mounted on said catch frame in spaced relation to said first hook.

4. The arrangement of claim 1 wherein said catch frame further comprises:

a first end which is pivotally mounted to said housing portion; and, a second end which comprises a catch member that cooperates with said latch assembly.

5. The arrangement of claim 1 wherein said latch assembly comprises:

a hinge mounted to said housing portion;

a cap secured to said hinge, said cap having an upper surface and a lower surface; and, a latch member located on said cap lower surface.

6. The arrangement of claim 5 wherein said latch assembly further comprises at least one indented section on said cap upper surface for accommodating an associated vacuum cleaner tool.

7. The arrangement of claim 5 wherein said latch assembly further comprises a first spring for biasing said cap to a first end position in relation to said housing portion.

8. The arrangement of claim 7 wherein said latch assembly further comprises a second spring for biasing said latch member to a first end position in relation to said cap.

9. The arrangement of claim 5 wherein said cap overlies an upper end of said dirt cup when said dirt cup is secured on said housing portion by a cooperation of said latch hook and said catch portion.

10. A latch arrangement for a vacuum cleaner having a dirt cup selectively mounted on a housing, comprising:

a latch hook pivotally mounted on a lower surface of a latch frame pivotally mounted on said housing; and, a catch member located on a catch frame pivotally mounted to said housing in a spaced manner from said latch frame, wherein said latch hook and said catch member are so mounted on said housing that they can selectively hold the dirt cup on the housing of the vacuum cleaner.

11. The arrangement of claim 10 wherein said catch frame comprises an electrical cord holding portion.

12. The arrangement of claim 11 wherein said catch frame cord holding portion comprises:

a first hook mounted on said frame; and, a second hook mounted on said frame in spaced relation to said first hook.

13. The arrangement of claim 12 wherein said catch frame further comprises:

a first end which is pivotally mounted to said housing; and, a second end which comprises said catch portion.

14. The arrangement of claim 11 wherein said latch frame comprises a cap having an upper surface and a lower surface.

15. The arrangement of claim 14 wherein said latch frame cap further comprises at least one indented section on said cap upper surface for accommodating an associated vacuum cleaner tool.

16. The arrangement of claim 15 further comprising:

a first spring for biasing said latch frame to a first end position in relation to said housing portion; and a second spring for biasing said latch hook to a first end position in relation to said cap.

17. The arrangement of claim 16 wherein said latch assembly further comprises a handle connected to said latch hook for manually manipulating said latch hook.

18. The arrangement of claim 15 wherein said latch frame cap overlies an upper end of said dirt cup when said dirt cup is secured on said housing by a cooperation of said latch hook and said catch portion.

* * * * *